US011560288B2

(12) United States Patent
Hatori et al.

(10) Patent No.: US 11,560,288 B2
(45) Date of Patent: Jan. 24, 2023

(54) ELEVATOR OPERATION MANAGEMENT SYSTEM AND ELEVATOR OPERATION MANAGEMENT METHOD

(71) Applicant: Hitachi, Ltd., Tokyo (JP)

(72) Inventors: Takahiro Hatori, Tokyo (JP); Masayasu Fujiwara, Tokyo (JP); Akira Omachi, Tokyo (JP); Takamichi Hoshino, Tokyo (JP); Satoru Toriyabe, Tokyo (JP); Manabu Kato, Tokyo (JP); Atsuya Fujino, Tokyo (JP); Wataru Toriumi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 445 days.

(21) Appl. No.: 16/755,995

(22) PCT Filed: Oct. 30, 2017

(86) PCT No.: PCT/JP2017/039115
§ 371 (c)(1),
(2) Date: Apr. 14, 2020

(87) PCT Pub. No.: WO2019/087242
PCT Pub. Date: May 9, 2019

(65) Prior Publication Data

US 2020/0299099 A1 Sep. 24, 2020

(51) Int. Cl.
*B66B 1/20* (2006.01)
*B66B 3/00* (2006.01)
*B66B 5/00* (2006.01)

(52) U.S. Cl.
CPC ..... *B66B 1/20* (2013.01); *B66B 3/00* (2013.01); *B66B 5/0012* (2013.01);
(Continued)

(58) Field of Classification Search
CPC ..... B66B 1/20; B66B 3/00; B66B 5/0012; B66B 2201/214; B66B 2201/222;
(Continued)

(56) References Cited

U.S. PATENT DOCUMENTS 5,168,136 A 12/1992 Thangavelu et al.
5,612,519 A * 3/1997 Chenais ..... B66B 1/2458 187/382
(Continued)

FOREIGN PATENT DOCUMENTS

EP 0 452 130 A2 10/1991
JP 4-226293 A 8/1992
(Continued)

OTHER PUBLICATIONS

International Search Report (PCT/ISA/210) issued in PCT Application No. PCT/JP2017/039115 dated Dec. 12, 2017 with English translation (five pages).
(Continued)

*Primary Examiner* — Jeffrey Donels
(74) *Attorney, Agent, or Firm* — Crowell & Moring LLP

(57) ABSTRACT

To make it possible to comprehensively predict the movement of people by associating an elevator control system in a facility such as a building and an external system other than this system with each other and thereby provide a new service that has not existed before. There is provided an elevator operation management system for controlling and managing multiple elevator devices in a facility, the system including: a reception unit that acquires information on the number of users to use the elevator devices and elevator car destination information; a learning unit that stores and learns, as past experience data, the information on the number of users and the elevator car destination information acquired from the reception unit; a per-floor number-of-
(Continued)

people estimation unit that estimates the number of users getting off at each elevator hall floor using storage information of the learning unit; and a request information output unit that outputs the number of people getting off thus estimated in the facility to a system other than the elevator operation management system.

12 Claims, 11 Drawing Sheets

(52) U.S. Cl.
CPC ... *B66B 2201/214* (2013.01); *B66B 2201/222* (2013.01); *B66B 2201/223* (2013.01); *B66B 2201/225* (2013.01); *B66B 2201/402* (2013.01)

(58) Field of Classification Search
CPC ..... B66B 2201/223; B66B 2201/225; B66B 2201/402
See application file for complete search history.

(56) References Cited

U.S. PATENT DOCUMENTS

| | | | | |
|---|---|---|---|---|
| 5,750,946 | A * | 5/1998 | Thangavelu | B66B 1/2458 187/382 |
| 5,841,084 | A * | 11/1998 | Thangavelu | B66B 1/2458 187/382 |
| 6,325,178 | B2 * | 12/2001 | Hikita | B66B 1/2458 187/382 |
| 6,672,431 | B2 * | 1/2004 | Brand | B66B 1/2458 187/382 |
| 7,711,565 | B1 * | 5/2010 | Gazdzinski | B66B 1/468 369/30.01 |
| 9,896,305 | B2 * | 2/2018 | Blandin | B66B 1/3461 |
| 11,232,312 | B2 * | 1/2022 | Chen | G06T 7/50 |
| 2016/0130112 | A1 * | 5/2016 | Nikovski | B66B 1/2458 187/247 |
| 2016/0292522 | A1 * | 10/2016 | Chen | B66B 1/3476 |
| 2016/0297642 | A1 * | 10/2016 | Finn | B66B 1/3476 |
| 2017/0369275 | A1 * | 12/2017 | Saraswat | B66B 1/3407 |
| 2018/0290859 | A1 * | 10/2018 | Barajas Gonzalez | G06N 5/04 |
| 2020/0130983 | A1 * | 4/2020 | Karve | B66B 1/2458 |

FOREIGN PATENT DOCUMENTS

| | | | |
|---|---|---|---|
| JP | 2003-95562 | A | 4/2003 |
| JP | 2005-200171 | A | 7/2005 |
| JP | 2009-173363 | A | 8/2009 |
| JP | 2012-126504 | A | 7/2012 |
| JP | 2013-175049 | A | 9/2013 |
| JP | 2014-177346 | A | 9/2014 |
| JP | 2016-183019 | A | 10/2016 |
| JP | 2017-52578 | A | 3/2017 |

OTHER PUBLICATIONS

Japanese-language Written Opinion (PCT/ISA/237) issued in PCT Application No. PCT/JP2017/039115 dated Dec. 12, 2017 (four pages).

Chinese-language Office Action issued in Chinese Application No. 201780096039.X dated Aug. 3, 2022 with English translation (20 pages).

* cited by examiner

FIG. 4A

ESTIMATED NUMBER OF PEOPLE GETTING ON

TB1

| TIME | 8:00:00 | 8:00:00 | 8:00:00 | 8:00:00 | 8:00:00 | 8:00:00 | 8:00:00 | 8:00:00 | D1 |
|---|---|---|---|---|---|---|---|---|---|
| FLOOR | 1FL | 2FL | 3FL | 4FL | 5FL | 6FL | 7FL | 8FL | D2 |
| ESTIMATED NUMBER OF PEOPLE | 20 | 9 | 7 | 14 | 13 | 7 | 8 | 5 | D3 |
| ACTUAL NUMBER OF PEOPLE | | | | | | | | | D4 |
| ACCURACY [%] | | | | | | | | | D5 |

FIG. 4B

ESTIMATED NUMBER OF PEOPLE GETTING OFF

TB2

| TIME | 8:00:00 | 8:00:00 | 8:00:00 | 8:00:00 | 8:00:00 | 8:00:00 | 8:00:00 | 8:00:00 | D6 |
|---|---|---|---|---|---|---|---|---|---|
| FLOOR | 1FL | 2FL | 3FL | 4FL | 5FL | 6FL | 7FL | 8FL | D7 |
| ESTIMATED NUMBER OF PEOPLE | 20 | 5 | 9 | 15 | 11 | 15 | 18 | 11 | D8 |
| ACTUAL NUMBER OF PEOPLE | | | | | | | | | D9 |
| ACCURACY [%] | | | | | | | | | D10 |

FIG. 5A

ESTIMATED NUMBER OF PEOPLE GETTING ON

TB1

| TIME | 8:00:00 | 8:00:00 | 8:00:00 | 8:00:00 | 8:00:00 | 8:00:00 | 8:00:00 | 8:00:00 | D1 |
|---|---|---|---|---|---|---|---|---|---|
| FLOOR | 1FL | 2FL | 3FL | 4FL | 5FL | 6FL | 7FL | 8FL | D2 |
| ESTIMATED NUMBER OF PEOPLE | 20 | 9 | 7 | 14 | 13 | 7 | 8 | 5 | D3 |
| ACTUAL NUMBER OF PEOPLE | 18 | 13 | 10 | 19 | 14 | 14 | 10 | 9 | D4 |
| ACCURACY [%] | 82 | 38 | 60 | 75 | 92 | 88 | 95 | 90 | D5 |

FIG. 5B

ESTIMATED NUMBER OF PEOPLE GETTING OFF

TB2

| TIME | 8:00:00 | 8:00:00 | 8:00:00 | 8:00:00 | 8:00:00 | 8:00:00 | 8:00:00 | 8:00:00 | D6 |
|---|---|---|---|---|---|---|---|---|---|
| FLOOR | 1FL | 2FL | 3FL | 4FL | 5FL | 6FL | 7FL | 8FL | D7 |
| ESTIMATED NUMBER OF PEOPLE | 20 | 5 | 9 | 15 | 11 | 15 | 18 | 11 | D8 |
| ACTUAL NUMBER OF PEOPLE | 17 | 13 | 15 | 12 | 12 | 17 | 19 | 10 | D9 |
| ACCURACY [%] | 89 | 69 | 70 | 74 | 93 | 50 | 80 | 56 | D10 |

FIG. 6A (1FL) ESTIMATED NUMBER OF PEOPLE GETTING OFF (t=1min)

TB2

| TIME | 8:00:00 | 8:01:00 | 8:02:00 | 8:03:00 | 8:04:00 | 8:05:00 | 8:06:00 | 8:07:00 | 8:08:00 | 8:09:00 | D6 |
|---|---|---|---|---|---|---|---|---|---|---|---|
| ESTIMATED NUMBER OF PEOPLE | 20 | 15 | 10 | 3 | 7 | 8 | 10 | 12 | 5 | 4 | D8 |
| ACTUAL NUMBER OF PEOPLE | 17 | 7 | 14 | 6 | 6 | 11 | 14 | 5 | 8 | 8 | D9 |
| ACCURACY [%] | 85 | 47 | 60 | 0 | 86 | 63 | 60 | 42 | 40 | 0 | D10 |

(1FL) ESTIMATED NUMBER OF PEOPLE GETTING OFF (t=5min) TB2

| TIME | 8:00:00 | 8:05:00 | D6 |
|---|---|---|---|
| ESTIMATED NUMBER OF PEOPLE | 55 | 39 | D8 |
| ACTUAL NUMBER OF PEOPLE | 50 | 46 | D9 |
| ACCURACY [%] | 91 | 82 | D10 |

ELEVATOR OPERATION MANAGEMENT SYSTEM AND ELEVATOR OPERATION MANAGEMENT METHOD

TECHNICAL FIELD

The present invention relates to an elevator operation management system and an elevator operation management method, and particularly relates to an elevator operation management system and an elevator operation management method having a function of estimating and outputting the number of people getting off an elevator device.

BACKGROUND ART

Heretofore, various proposals have been made on operation management of elevator devices. However, actually, many of these proposals are made while assuming a scene where users of an elevator device gets on an elevator car and are transported to their destination floors, and relatively few proposals take into account a scene where users get off an elevator car or a scene after users get off an elevator car.

PTL 1 and PTL 2 are examples proposing improvement in a scene where users get off an elevator car.

For example, PTL 1 proposes a system in which: a time period needed for passengers, who are expected to get off at each floor at which an elevator car is to stop, to get off the elevator car is set as a get-off period; after this get-off period is over, a time period needed for at least one passenger to get on the elevator car is set as a get-on period and this get-on period is updated and newly set every time a passenger gets on the elevator car; and, after this get-on period is over, a door close command is issued to close a door.

Meanwhile, in a get-off state prediction presentation system of PTL 1, an image processing device 6: recognizes the number of users and the number of transportable cars that are included in in-car state information obtained from image information made by subjecting in-car image information from a car-side camera 5 for user recognition to image processing; groups and classifies the various sets of information into groups; recognizes destination floor registration information that indicates which button has been pressed in a car destination floor registration device 2 installed in an elevator car 1 that corresponds to each of the groups thus classified; and calculates and estimates the number of people getting off, indicating how many people are to get off at each floor, and car occupancy of the elevator car 1 based on this number of people by use of the various sets of information, and an elevator control device 7 displays on an elevator hall display 8 a result of judgment on the user's availability at each elevator hall floor based on the calculation result.

PATENT LITERATURE

PTL 1: JP 2003-95562 A
PTL 2: JP 2017-52578 A

SUMMARY OF INVENTION

Technical Problem

Recently, with highly use of the Internet and computer systems, the processing of so-called big data or the use of AI technology has been attempted in various fields.

When a near-future elevator control system is viewed from such perspective, although the elevator control system installed in a facility such as a building according to the patent document examples described above controls each of elevators or multiple elevators from various perspectives, these are just operation management for users at upper and lower floors inside a building and do not take into consideration the relationship between the entire facility such as a building and the outside.

In particular, when scenes inside a facility such as a building and outside the facility are viewed in comparison with each other, these examples are not designed for performing elevator operation management while users having gotten off an elevator car and then leaving a facility such as a building to the outside or conversely users to use an elevator having entered a facility such as a building from the outside are understood in macro perspective.

On the other hand, in a society where the Internet and computer systems are highly used, it is presumed to be capable of comprehensively predicting the movement of people by associating an elevator control system in a facility such as a building and an external system other than this system with each other and thereby providing a new non-existing service.

Solution to Problem

Against the above background, the present invention provides "an elevator operation management system for controlling and managing multiple elevator devices in a facility, the system including: a reception unit that acquires information on the number of users to use the elevator devices and elevator car destination information; a learning unit that stores and learns, as past experience data, the information on the number of users and the elevator car destination information acquired from the reception unit; a per-floor number-of-people estimation unit that estimates the number of users getting off at each elevator hall floor using storage information of the learning unit; and a request information output unit that outputs the number of people getting off thus estimated in the facility to a system other than the elevator operation management system".

In addition, the present invention provides "an elevator operation management method performed by an elevator operation management system for controlling and managing multiple elevator devices in a facility, the method being characterized by including: storing, as past experience data, information on the number of users to use the elevator devices and elevator car destination information; estimating the number of users getting off at each elevator hall floor using the past experience data thus stored; and outputting the number of people getting off thus estimated in the facility to a system other than the elevator operation management system".

Advantageous Effects of Invention

The present invention makes it possible to comprehensively predict the movement of people by associating an elevator control system in a facility such as a building and an external system other than this system with each other and thereby provide a new non-existing service.

BRIEF DESCRIPTION OF DRAWINGS

FIG. 4A is a diagram illustrating an example of a table TB1 of the estimated number of people getting on estimated by a per-floor number-of-people estimation unit 32;

FIG. 4B is a diagram illustrating an example of a table TB2 of the estimated number of people getting off estimated by the per-floor number-of-people estimation unit 32;

FIG. 5A is a diagram illustrating an example of the table TB1 of the estimated number of people getting on containing actual data added by an accuracy verification unit 33;

FIG. 5B is a diagram illustrating an example of the table TB2 of the estimated number of people getting off containing actual data added by the accuracy verification unit 33;

FIG. 6A is a diagram illustrating an example of outputting the estimated number of people getting off in time series (in units of one minute);

DESCRIPTION OF EMBODIMENTS

Hereinbelow, embodiments of the present invention are described using the drawings.

First Embodiment

Figure 1:
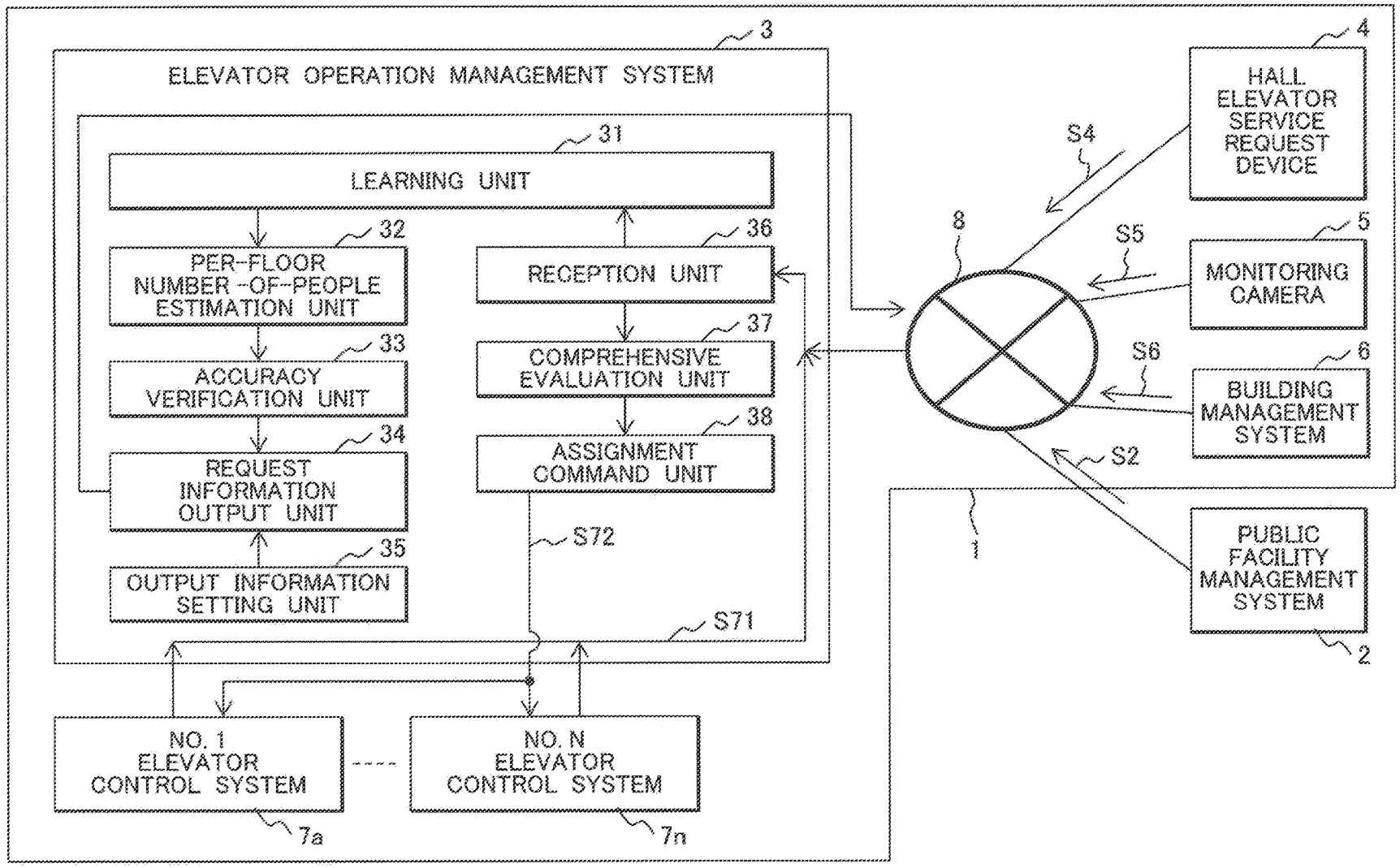
FIG. 1 is a diagram illustrating a schematic configuration of an elevator operation management system according to the present invention.

FIG. 1 illustrates a schematic configuration of an elevator operation management system according to the present invention. Equipment and system in a facility such as a building 1 and an external system 2 are illustrated here.

The equipment and system in the facility such as the building 1 typically include: an elevator operation management system 3; a hall elevator service request device 4 at each floor; a monitoring camera 5 at each floor; a building management system 6; and the like, and they perform data communication with each other via a communication unit 8. In addition, multiple elevator control systems 7*a* to 7*n* are installed, and the elevator operation management system 3 controls them. Note that, in implementing the present invention, the elevator operation management system 3 and the building management system 6 are not necessarily the equipment and system inside the facility such as the building 1. As long as these systems perform data communication with each other via the communication unit 8, their functions may be partially or wholly installed outside the facility such as the building 1 and the same control and monitoring operations are available with such systems.

Although FIG. 1 illustrates a public facility management system as an example of the external system 2, it may be another system such as a taxi assignment system.

The elevator operation management system 3 according to the present invention makes outputs by acquiring many inputs and settings. Among these inputs and outputs, between the elevator control systems 7*a* to 7*n* and the elevator operation management system 3, the elevator control systems 7*a* to 7*n* reports their operational status information S71 to the elevator operation management system 3, and the elevator operation management system 3 selects an elevator to be assigned among those of the elevator control systems 7*a* to 7*n* through a control command signal S72 after any of elevator hall buttons of each elevator is pressed. The characteristic point to be mentioned here is that the elevator operation management system 3 operates and manages all the elevators in the building 1. The others are the same as those of typical elevator control and therefore are not described here.

In the present invention, the system also acquires other inputs such as a service request signal S4 from the hall elevator service request device 4 at each floor, a video signal S5 from the monitoring camera 5 at each floor, building management information S6 from the building management system 6, and public facility management information S2 from the public facility management system 2.

Figure 2:
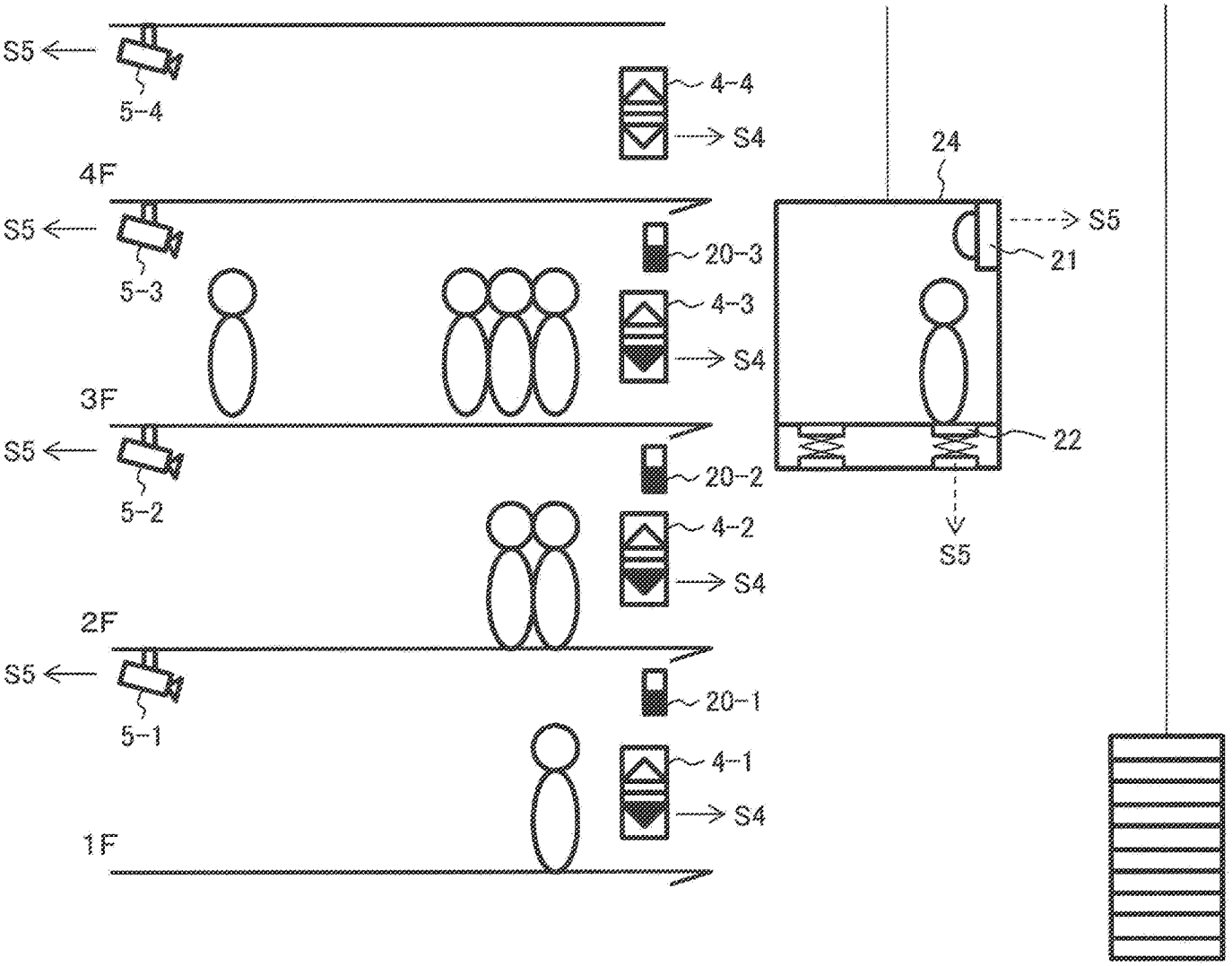
FIG. 2 is a diagram illustrating an example of elevator hall environment preferable for the present invention.

FIG. 2 is a diagram illustrating an example of elevator hall environment preferable for the present invention. In the elevator hall at each floor, the monitoring camera 5 (5-1, 5-2, 5-3, 5-4) configured to monitor and record a space including elevator doors, the up/down button 4 (4-1, 4-2, 4-3, 4-4) as the hall elevator service request device 4 are arranged. In addition, in FIG. 2, reference numeral 20 (20-1, 20-2, 20-3) indicates a lantern indicating a direction an elevator car currently goes. In FIG. 2, an in-car camera 21 and a load sensor 22 are arranged inside an elevator car 24.

As will be described later, the service request signal S4 in the present invention is defined as one for checking the direction of an elevator (up or down) and the up/down button 4 is illustrated in FIG. 2; however, another device such as a destination floor registration device may be used instead.

In addition, the video signal 5 in the present invention is defined as one for calculating the number of users, and any device may be used instead as long as it can estimate or check the number of users directly or indirectly. In the example of FIG. 2, information on the number of users can be acquired from the in-car camera 21 disposed inside the elevator car 24 and the load sensor 22 disposed in a lower part inside the elevator car 24.

In this manner, information on whether the destination floor of a user using the elevator is located above or below the floor where the elevator hall button is disposed can be checked from the service request signal S4, information on the number of users can be checked from the video signal S5, information on the schedule of activities such as meetings and events in the facility can be checked from the building management information S6, and public facility operation information (e.g. train delay) of the day can be found from the public facility management information S2. Note that these pieces of information include ones that are input in other existing systems and used for some purposes respectively; what is new in the present invention is that these pieces of information are used for estimating the estimated number of people getting off.

A reception unit 36 in the elevator operation management system 3 of FIG. 1 acquires information such as the service request signal S4, the video signal S5, and the building management information S6 via the communication unit 8, and receives inputs of the operational status information S71 from the elevator control systems 7*a* to 7*n*. Here, the operational status information S71 includes information on the location of the elevator car. A comprehensive evaluation unit 37 judges the request and travel direction of a user from these signals, and an assignment command unit 38 gives the control command signal S72 to and controls each of the elevator control systems 7*a* to 7*n*. This part is the same as that of the existing elevator control, so further description thereof is omitted.

The information such as the service request signal S4, the video signal S5, and the building management information S6 acquired via the communication unit 8 is recorded and used in the learning unit 31. In addition, the actual number of people getting on and getting off at each floor can be found based on information on the number of users, acquired from the in-car camera 21 disposed inside each elevator car 24 and the load sensor 22 disposed in the lower part inside the elevator car 24, and the location of the elevator car which are sent by the elevator control systems 7*a* to 7*n*. Here, the service request signal S4 and the video signal S5 are used as past experience information by being stored with information on the time when these signals were generated. Thereby, the behavior and appearance of users at a certain scene (e.g. day of the week, season) and at a certain time can be found statistically. For example, outline information on how users move when they come to work, when they eat lunch, and when they leave work, etc. can be found. Accordingly, although people do not act the same way on an individual basis, it is possible to presume that the traffic flow of users in the entire building in a similar future scene will be the same as that in the past experience when it is seen in macro perspective.

These pieces of information acquired by the reception unit 36 include elevator car destination information. The elevator car destination information is information on the direction in which an elevator car goes, the destination floor of an elevator car, or the location of an elevator car. Note that the information on the location of an elevator car can be used as destination information by being acquired in time series.

While the service request signal S4 and the video signal S5 are used as past experience information, the building management information S6 from the building management system 6 indicates information, registered in the building management system 6, on the schedule (place where an activity is held, attendees, and their place to sit on) of activities such as meetings and events to be held in the facility in a near future, for example. With this building management information, it is possible to predict how users at each floor moves when a meeting is to be held from 3 o'clock today, for example.

In addition, if public facility operation information of the day, such as a train delay and the degree of this delay, can be found from the public facility management information S2, it is possible to predict that the movement of users with train delay differs and changes from the normal movement of users without delay especially when they go to work. As is apparent from the above, the public facility management information S2 can be used as information on modification of presumption defined by past experience information or schedule in a near future.

In this manner, the learning unit 31 daily learns the number of users using an elevator in a normal scene. Past experience data learned by the learning unit 31 are organized and stored as illustrated in FIG. 3, for example.

Figure 3:
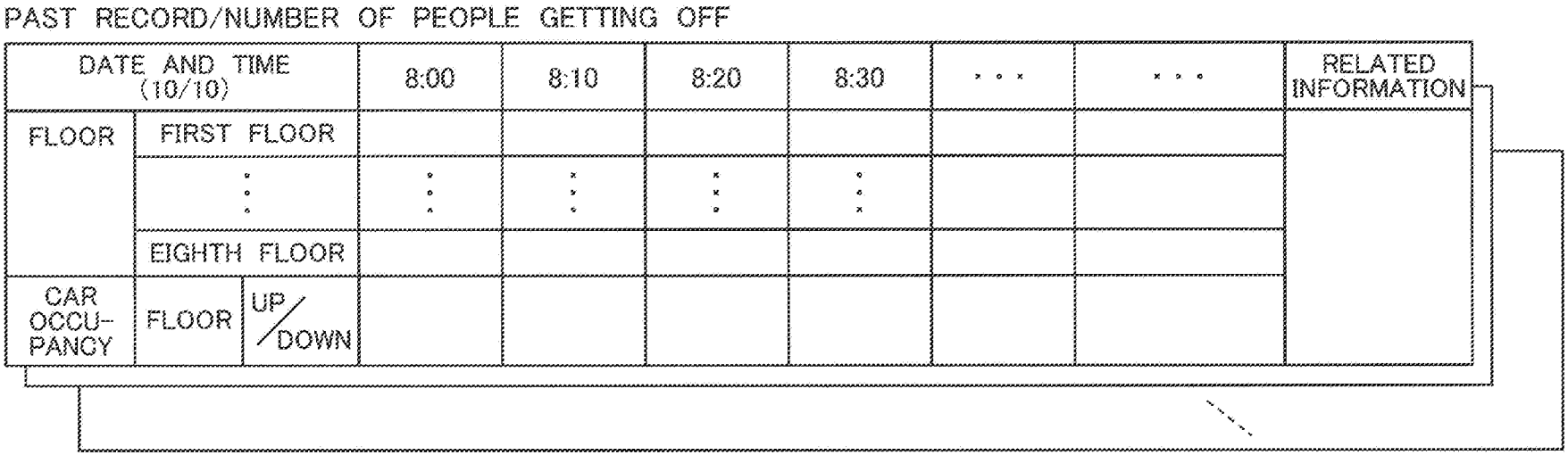
FIG. 3 is a diagram illustrating an example of formatting past experience data learned by a learning unit 31.

FIG. 3 illustrates a storage format of the past record/number of people of getting on, for example. Information on the number of people getting on and getting off at each floor and information on up/down car occupancy at each floor is associated with each other and stored in this format for each past date. A storage format of the past record/number of people of getting off is also created in the same manner. Note that the above storage format preferably includes information on the number of people acquired each day for every five minutes, for example, and accumulated over a past long period of time. This five minutes is the time width used as a measure that is used at the time of planning installation of elevators, and is not limited to this. For example, it is also possible to set the time width at for every period of time each elevator goes round, or at a fixed width other than five minutes. In addition, it is also possible to calculate the number of people at a resolution of one minute and convert the calculated data into ones for every five or ten minutes as appropriate. Further, the past experience data preferably contains, as associated information, information on activities such as meetings and various events. The past experience data learned by the learning unit 31 is used as past experience for a prediction process in the following processing.

From the past experience and meeting schedule of the day etc., the per-floor number-of-people estimation unit 32 predicts, for each floor, the movement of people from the present at a given time width or the movement of people in the traffic flow of the building recognized by the learning unit. FIG. 4A illustrates an example of a table TB1 of the estimated number of people getting on estimated by the per-floor number-of-people estimation unit 32, and FIG. 4B illustrates an example of a table TB2 of the estimated number of people getting off estimated by the per-floor number-of-people estimation unit 32.

Each of the table TB1 of the estimated number of people getting on and the table TB2 of the estimated number of people getting off is composed of, in the order from above: time data D1 and D6; floor data D2 and D7; estimated number-of-people data D3 and D8; actual number-of-people data D4 and D9; and prediction accuracy data D5 and D10. The per-floor number-of-people estimation unit 32 uses the past experience data of FIG. 3, etc. to form data in these tables ranging from the top to the third row.

The table TB1 of the estimated number of people getting on indicates that the numbers of people getting on at 8 o'clock (e.g. five minutes period from 8 o'clock as will be described later) at floors (here, the first to eighth floors) are estimated to be 20, 9, 7, 14, 13, 7, 8, and 5 respectively, for example. Meanwhile, the table TB2 of the estimated number of people getting off indicates that the numbers of people getting off at 8 o'clock (e.g. five minutes period from 8 o'clock as will be described later) at the floors (here, the first to eighth floors) are estimated to be 20, 5, 9, 15, 11, 15, 18, and 11 respectively, for example.

Note that, as described previously, the table TB1 of the estimated number of people getting on and the table TB2 of the estimated number of people getting off can be created in consideration of the past experience and schedule of the day. Further, by modifying the data in consideration of a train delay of the day etc., it is possible to increase the accuracy of these tables.

Based on actual experience, the accuracy verification unit 33 adds data in the lower two rows to the data in the upper three rows created by the per-floor number-of-people estimation unit 32. FIG. 5A is a diagram illustrating an example of the table TB1 of the estimated number of people getting on containing actual data added by the accuracy verification unit 33, and FIG. 5B is a diagram illustrating an example of the table TB2 of the estimated number of people getting off containing actual data added by the accuracy verification unit 33.

In this example, in the table TB1 of the estimated number of people getting on for example, although the numbers of people getting on at 8 o'clock (e.g. five minutes period from 8 o'clock as will be described later) at the floors (here, the first to eighth floors) have been estimated to be 20, 9, 7, 14, 13, 7, 8, and 5 respectively, they have turned out to be 18, 13, 10, 19, 14, 14, 10 and 9 and their accuracy have turned out to be 82, 38, 60, 75, 92, 88, 95, and 90% respectively.

Meanwhile, in the table TB2 of the estimated number of people getting off for example, although the numbers of people getting off at 8 o'clock (e.g. five minutes period from 8 o'clock as will be described later) at the floors (here, the first to eighth floors) have been estimated to be 20, 5, 9, 15, 11, 15, 18, and 11 respectively, they have turned out to be 17, 13, 15, 12, 12, 17, 19, and 10 and their accuracy have turned out to be 89, 69, 70, 74, 93, 50, 80, and 56% respectively.

These accuracy values are calculated for every time width. Here, as described previously, the time width is set based on a measure used for traffic calculation and is not limited to this. The accuracy values thus calculated are stored in the learning unit 31, and are stored for each time slot and for each floor in this embodiment. These values may be stored for each traffic flow, for each day of the week, or for each event. As described previously, accuracy information to be stored is calculated from prediction information and actual value of each day and used for calculating the next estimated number of people. This information is used in such a way that a weighted average of past values at the corresponding time slot and at the corresponding floor is found so that values of the day near today are weighed. How to use this information is not limited to this, and it is also possible to directly use an average accuracy value of the past 10-day data found on the previous day or use the largest value of such average values. It is preferable that statistical information calculated in the past be used by use of statistics method.

A request information output unit 34 processes the information on the estimated number of people getting off, found by the accuracy verification unit 33, as needed according to the setting information from an output information setting unit 35, and output the resultant data to the outside of the elevator operation management system 3. Examples of such external output destination include the building management system 6 and the public facility management system as the external system 2.

Note that the time width, designated time, etc. are provided as the setting content by the output information setting unit 35.

In many cases, any output format (display format) may be employed for the information on the estimated number of people getting off that is output from the request information output unit 34. In an extreme case, unprocessed raw information may be used; in this case, the building management system 6 or the external system 2 which uses this information can use the information by interpreting and processing it as needed according to the purpose of use. Hereinbelow, output examples and use examples are described.

Figures 6B, 7:
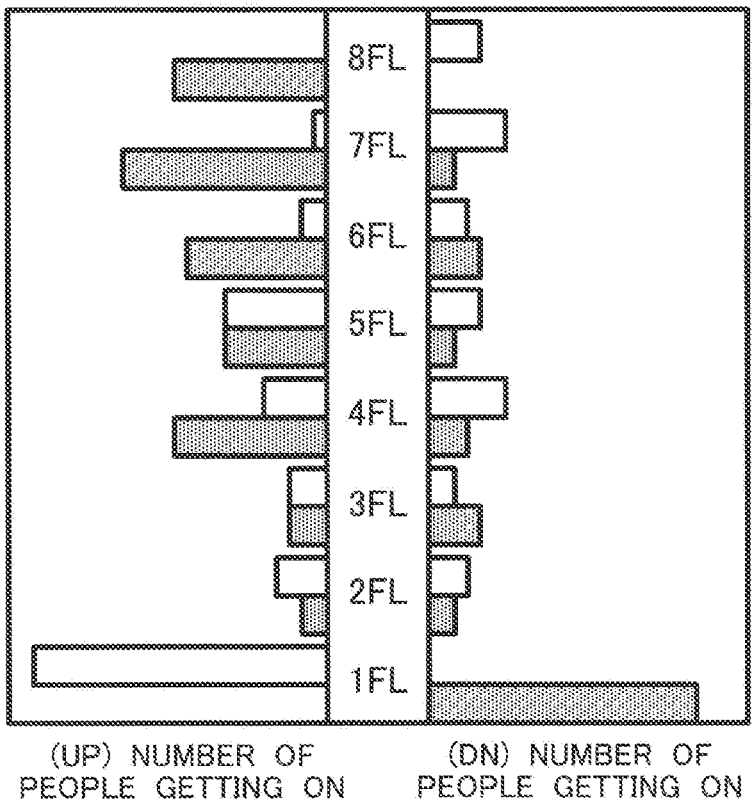
FIG. 6B is a diagram illustrating an example of outputting the estimated number of people getting off in time series (in units of five minutes)
FIG. 7 is a diagram illustrating an example of outputting on a display the estimated number of people getting on and getting off at each floor.

FIGS. 6A and 6B are diagrams each illustrating an example of outputting the estimated number of people getting off in time series. In these drawings, basically, time data D6, estimated number-of-people data D8, actual number-of-people data D9, and prediction accuracy data D10 in the table TB2 of the estimated number of people getting off are organized as time-series data acquired for every one minute (FIG. 6A) or for every five minutes (FIG. 6B). Note that the time width (for every one minute or for every five minutes) or the time between 8 o'clock and 9 o'clock are defined in accordance with the time width setting and time setting from the output information setting unit 35.

The time-series information on the estimated number of people getting off can be used, for example, by a taxi company which assigns taxis in front of the hallway of a facility such as a building. By assigning the cabs before the time the hallway is crowded with people leaving the facility and thus taxi users are expected to increase, it is possible to assign taxis efficiently.

Note that, besides being used as information to be transmitted to the outside of the building, this information is also usable inside the building. For example, time-series information on the estimated number of people getting off is transmitted to tenants of the building. This enables the tenants in the building such as a restaurant to set an employee's schedule adequately in advance. In addition, by using this information for a building air-conditioning system schedule, it is possible to make air conditioners output air in advance to a floor, where many people are expected to get off, according to the number of people getting off, and thereby provide a comfortable space.

Figure 8:
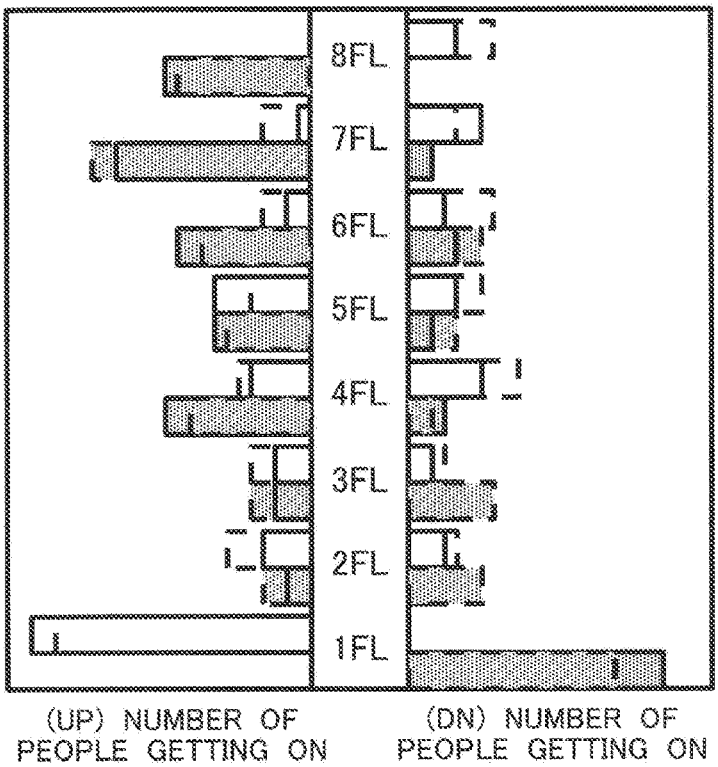
FIG. 8 is a diagram illustrating an example of outputting on a display the estimated number and the actual number of people getting on and getting off at each floor.

FIG. 7 illustrates display output of estimated values of the number of people getting on and getting off at each floor, and FIG. 8 further illustrates actual values (with dotted lines) superimposed on the estimated values. This information is an easy-to-understand version of FIGS. 5A and 5B. For example, the elevator operation management system 3 outputs the aforementioned estimated values and actual values upon request of past one day's per-hour information via the network 8. This information is output on a monitoring panel or a PC installed in an administration office of the building or on a web content administration screen for building management so as to show a daily building users' state to building managers. By visualizing how the building is used in this manner, managers can organize the security of the building and the schedule of air-conditioning facilities flexibly. Here, it is also possible to output actual values only without outputting estimated values.

Figure 9:
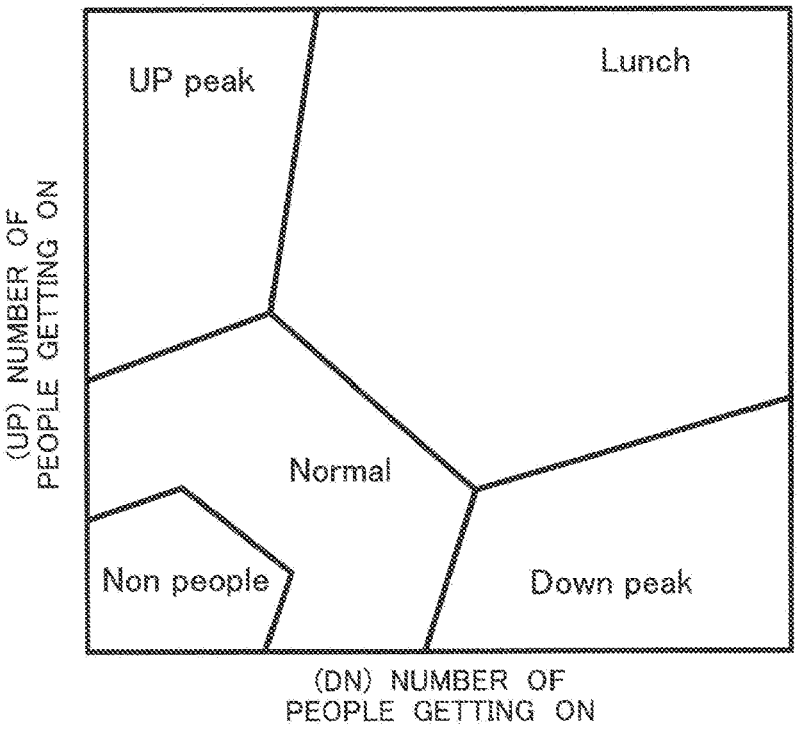
FIG. 9 is a diagram illustrating an example of outputting on a display the number of people getting on and getting off, arranged on vertical and horizontal axes, so that we can know how much an elevator is being used.

FIG. 9 illustrates an example of outputting on a display the number of people getting on and getting off, arranged on vertical and horizontal axes, so that we can know how much an elevator is being used. Through areas defined by the number of people getting on and getting off arranged on the vertical and horizontal axes, it is possible to identify normal use, lunch, and up and down peaks, for example.

Figure 10:
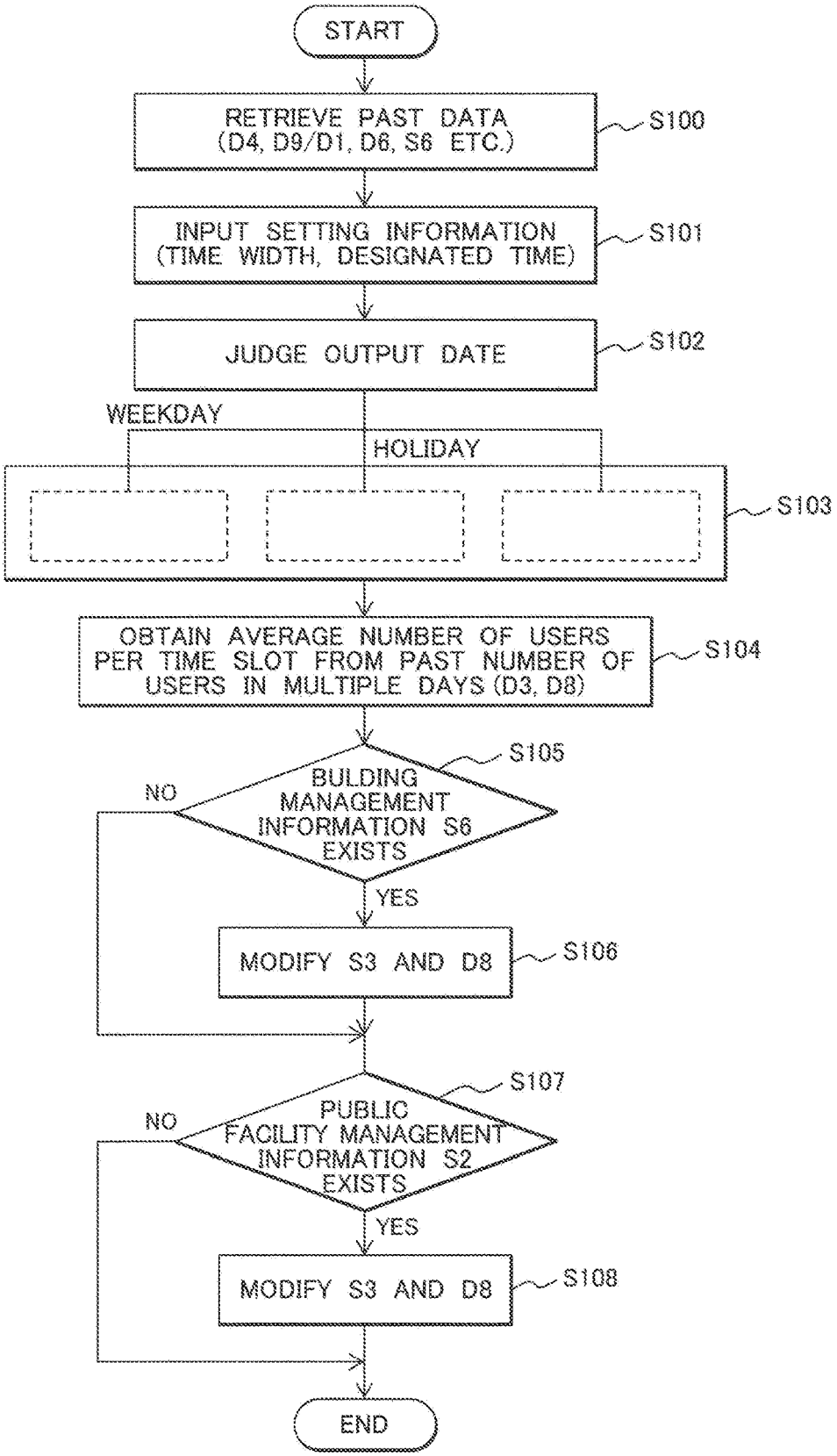
FIG. 10 is a flowchart specifically illustrating processing executed by the per-floor number-of-people estimation unit 32 of FIG. 1.

FIG. 10 is a flowchart specifically illustrating processing executed by the per-floor number-of-people estimation unit 32 of FIG. 1. Note that this processing is premised on the fact that time-series information on the number of users calculated each day is acquired with up/down-direction car occupancy at each floor through the processing by the learning unit 31 and the past experience data of FIG. 3 is thereby formed. In other words, in the table TB1 of the estimated number of people getting on and the table TB2 of the estimated number of people getting off, past experience data for a considerable number of days corresponding to actual number-of-people data D4 and D9 shall be secured and stored in chronological order. In addition, these pieces of data are stored with information on events and meetings held in the corresponding day in the past.

The processing of FIG. 10 may be started at any appropriate timing. For example, if data is provided the previous day to be used as the next day's information, the processing is performed at an appropriate time on this previous day. Alternatively, if data is provided upon request from the outside, the processing may be started upon receipt of such request.

At the first Processing Step S100 of the per-floor number-of-people estimation unit 32, the per-floor number-of-people estimation unit 32 retrieves data such as past experience data. The retrieved data includes actual number-of-people data D4 and D9, time data D1 and D6, building management information S6, etc. At Processing Step S101, the per-floor number-of-people estimation unit retrieves setting information, such as the time width and designated time, from the output information setting unit 35.

At Processing Step S102, an output date (e.g. tomorrow) is judged. It is judged whether the output date is a weekday, a holiday, or partial halt, and only data that matches the conditions is extracted from the past experience data of FIG. 3. At Processing Step S103, for example, only weekday's past experience data is extracted if the output date is a weekday, and only holiday's past experience data is extracted if the output date is a holiday. Note that, if users vary depending on seasons, it is preferable that data be extracted in consideration of this point.

At Processing Step S104, a use average at each time is found from the multiple-day time-series use records thus extracted, and this average data is set as estimated number-of-people data D3 and D8 in the table TB1 of the estimated number of people getting on and the table TB2 of the estimated number of people getting off. Here, since the above processing is performed on the number of users at each floor, floor data D2 and D7 are also acquired in addition to the above data.

At Processing Step S105, it is checked whether the building management information S6 exists. If a meeting is to be held from 15:00 today, for example, at Processing Step S106 the estimated number-of-people data D3 and D8 in the table TB1 of the estimated number of people getting on and the table TB2 of the estimated number of people getting off obtained at Processing Step S104 are modified by reflecting the movement of users and how much the users use elevators on these pieces of data according to the size of the meeting. Note that, if the past experience data includes experience data where the meeting of the same theme as that of this meeting was held in the past, it is preferable that the estimated number-of-people data D3 and D8 in the table TB1 of the estimated number of people getting on and the table TB2 of the estimated number of people getting off be modified with reference to user information at that time.

At Processing Step S108, it is checked whether the public facility management information S2 exists. For example, if there is information that a train scheduled to arrive at the nearest station from the building at 8 o'clock today is delayed, at Processing Step S108 the estimated number-of-people data D3 and D8 in the table TB1 of the estimated number of people getting on and the table TB2 of the estimated number of people getting off obtained at Processing Steps S104 and S106 is modified by reflecting the movement of users and how much the users use elevators on these pieces of data according to the degree of delay.

As has been described above, the estimated number-of-people data D3 and D8 in the table TB1 of the estimated number of people getting on and the table TB2 of the estimated number of people getting off is obtained by modifying the past record based on the activity schedule and public facility information.

The information on the estimated number of people getting off thus created is provided to the outside of the elevator operation management system 3 and thereby can be reflected on the operation of a destination system to which the information is provided. This can contribute to the realization of more advanced society.

INDUSTRIAL APPLICABILITY

In a society where the Internet and computer systems are highly used, information on people leaving a building can be used as a part of big data.

REFERENCE SIGNS LIST

1: facility such as building, 2: external system (public facility management system), 3: elevator operation management system, 4: hall elevator service request device at each floor, 5: monitoring camera at each floor, 6: building management system, 7*a* to 7*n*: elevator control system, 8: communication unit, 31: learning unit, 32: per-floor number-of-people estimation unit, 33: accuracy verification unit, 34: request information output unit, 35: output information setting unit, 36: reception unit, 37: comprehensive evaluation unit, 38: assignment command unit, S2: public facility management information, S4: service request signal, S5: video signal, S6: building management information, S72: control command signal.

The invention claimed is:

1. An elevator operation management system for controlling and managing a plurality of elevator devices in a facility, comprising:

a reception unit that acquires information on the number of users to use the elevator devices and elevator car destination information;

a learning unit that stores and learns, as past experience data, the information on the number of users and the elevator car destination information acquired from the reception unit;

a per-floor number-of-people estimation unit that estimates the number of users getting off for each time slot as a total in each elevator hall floor using storage information of the learning unit; and a request information output unit that outputs the number of people getting off thus estimated in the facility to a system other than the elevator operation management system.

2. The elevator operation management system according to claim 1, wherein the elevator operation management system acquires information on an activity schedule in the facility, and estimates the number of users getting off at each elevator hall floor based on the activity schedule information and the past experience data.

3. The elevator operation management system according to claim 1, wherein the elevator operation management system acquires operation information of a public facility, and estimates the number of users getting off at each elevator hall floor based on the operation information and the past experience data.

4. The elevator operation management system according to claim 1, wherein the elevator operation management system outputs the number of people getting off estimated in the facility to the system other than the elevator operation management system while adding thereto information on the actual number of people getting off and prediction accuracy information.

5. The elevator operation management system according to claim 1, wherein the number of people getting off estimated in the facility that is output to the system other than the elevator operation management system is the number of people in a preset time slot, and is provided as time-series information.

6. The elevator operation management system according to claim 1, wherein the elevator car destination information is any of information on a direction in which an elevator car goes, a destination floor of an elevator car, and a location of an elevator car.

7. An elevator operation management method performed by an elevator operation management system for controlling and managing a plurality of elevator devices in a facility, comprising:

storing, as past experience data, information on the number of users to use the elevator devices and elevator car destination information;

estimating the number of users getting off for each time slot as a total in each elevator hall floor using the past experience data thus stored; and outputting the number of people getting off thus estimated in the facility to a system other than the elevator operation management system.

8. The elevator operation management method according to claim 7, wherein the elevator operation management system acquires information on an activity schedule in the facility, and estimates the number of users getting off at each elevator hall floor based on the activity schedule information and the past experience data.

9. The elevator operation management method according to claim 7, wherein the elevator operation management system acquires operation information of a public facility, and estimates the number of users getting off at each elevator hall floor based on the operation information and the past experience data.

10. The elevator operation management method according to claim 7, wherein the elevator operation management system outputs the number of people getting off estimated in the facility to the system other than the elevator operation management system while adding thereto information on the actual number of people getting off and prediction accuracy information.

11. The elevator operation management method according to claim 7, wherein the number of people getting off estimated in the facility that is output to the system other than the elevator operation management system is the number of people in a preset time slot, and is provided as time-series information.

12. The elevator operation management method according to claim 7, wherein the elevator car destination information is any of information on a direction in which an elevator car goes, a destination floor of an elevator car, and a location of an elevator car.

* * * * *